US008701533B2

(12) United States Patent
Nihashi et al.

(10) Patent No.: US 8,701,533 B2
(45) Date of Patent: Apr. 22, 2014

(54) SHEET MATERIAL CUTTING DEVICE AND PRINTER USING THE SAME

(75) Inventors: Kiyotaka Nihashi, Shizuoka (JP); Tsuyoshi Sanada, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 512 days.

(21) Appl. No.: 12/860,495

(22) Filed: Aug. 20, 2010

(65) Prior Publication Data

US 2011/0107885 A1 May 12, 2011

(30) Foreign Application Priority Data

Nov. 6, 2009 (JP) ..... 2009-255458

(51) Int. Cl.
*B26D 7/08* (2006.01)

(52) U.S. Cl.
USPC ..... 83/349; 83/341

(58) Field of Classification Search
USPC ..... 83/349, 341, 342; 400/621
See application file for complete search history.

(56) References Cited

U.S. PATENT DOCUMENTS

| | | | | |
|---|---|---|---|---|
| 1,653,129 | A * | 12/1927 | Taylor | 83/342 |
| 3,190,163 | A * | 6/1965 | Bradley | 83/342 |
| 3,230,809 | A * | 1/1966 | Luck | 83/341 |
| 5,690,009 | A * | 11/1997 | Nakao et al. | 83/76.8 |

FOREIGN PATENT DOCUMENTS

| | | | |
|---|---|---|---|
| BE | 663042 | A | 8/1965 |
| DE | 3743530 | A1 | 7/1989 |
| EP | 0204866 | A1 | 12/1986 |
| GB | 1116241 | A | 6/1968 |
| JP | 2009148875 | | 7/2009 |

OTHER PUBLICATIONS

Extended European Search Report for Application No. 10173812.8 -2302 dated Feb. 25, 2011.

* cited by examiner

*Primary Examiner* — Stephen Choi
(74) *Attorney, Agent, or Firm* — Amin, Turocy & Watson, LLP

(57) ABSTRACT

According to one embodiment, a sheet material cutting device includes a rotatable blade including a blade unit, which extends from one end of the rotary shaft to the other end thereof and defines a predetermined angle relative to an axial direction of the rotary shaft, provided on the outer circumference of a rotary shaft rotatably supported by a support frame. The sheet material cutting device further includes a fixed blade mounted on the support frame so as to be opposed to the rotatable blade and configured to cut a sheet material in a transverse direction perpendicular to the feed direction of the sheet material that is perpendicular to the axial direction of the rotary shaft. The sheet material cutting device further includes a sheet-suspension prevention unit configured to prevent a rear edge of the sheet material in its feed direction from being suspended within the support frame.

8 Claims, 5 Drawing Sheets

SHEET MATERIAL CUTTING DEVICE AND PRINTER USING THE SAME

CROSS-REFERENCE TO RELATED APPLICATIONS

This application is based upon and claims the benefit of priority from Japanese Patent Application No. 2009-255458, filed on Nov. 6, 2009, the entire content of which is incorporated herein by reference.

FIELD

Embodiments described herein relate generally to a sheet material cutting device which includes a rotatable blade and a fixed blade so as to cut a printed sheet material by engagement between the rotatable blade and the fixed blade, and a printer using the sheet material cutting device.

BACKGROUND

In a conventional sheet material cutting device, which is provided in a printer, a printed sheet material is cut in a transverse direction perpendicular to the feed direction of the sheet material while it is being conveyed. In such a sheet material cutting device, the sheet material is cut in a transverse direction perpendicular to the feed direction thereof by the engagement between a rotatable blade and a fixed blade located opposite the rotatable blade. The rotatable blade may include a blade unit provided on the outer circumference of a rotary shaft, the blade unit defining a predetermined angle relative to an axial direction of the rotary shaft while extending from one end of the rotary shaft to the other end thereof. In such a rotatable blade, the outer circumference (hereinafter, referred to as "forward shaft surface") of the rotary shaft, which is defined in the direction in front of the blade unit as it rotates along the rotary shaft, also serves as a guide portion which feeds the sheet material toward the fixed blade in response to rotation of the rotary shaft. For this purpose, the forward shaft surface is formed in a circular arc shape along the rotational direction of the rotary shaft.

The forward shaft surface of the rotatable blade functions to press downward on a rear edge of the sheet material cut by the rotation of the rotatable blade. A conventional printer includes a conveying mechanism disposed in the downstream side of the sheet material cutting device to convey the sheet material in a state of being interposed therein. The cut sheet material is withdrawn and discharged to the outside by the conveying mechanism arranged in the downstream side of the cutting device.

However, the printer may have a complicated configuration due to the arrangement of the conveying mechanism in the downstream side of the sheet material cutting device. Particularly, a sheet discharge portion protrudes outward from the printer, which leads to an increase in an outer shape of the printer. For this reason, miniaturization of the printer is increasingly contemplated by arranging the conveying mechanism for withdrawing the cut sheet material in a position other than the downstream side of the sheet material cutting device.

This sheet material cutting device entails a problem in that when the leading edge of the cut sheet material is pressed downward by the forward shaft surface of the rotatable blade, it is bent downward and deformed, which frequently prevents the cut sheet material from being smoothly discharged to the outside. That is, the leading edge of the cut sheet material is suspended within the device, which contributes to the blockage of discharge or paper jam. In addition, if a user attempts to pull out the suspended leading edge portion of the cut sheet material which is caught between component parts within the device, the sheet material may be damaged.

DETAILED DESCRIPTION

According to one embodiment, a sheet material cutting device includes a rotatable blade including a blade unit, which extends from one end of the rotary shaft to the other end thereof and defining a predetermined angle relative to an axial direction of the rotary shaft, provided on the outer circumference of a rotary shaft rotatably supported by a support frame. The sheet material cutting device further includes a fixed blade mounted on the support frame so as to be opposite the rotatable blade and configured to cut a sheet material in a transverse direction perpendicular to the feed direction of the sheet material, in which the sheet material is fed by rotation of the rotatable blade in a direction perpendicular to the axial direction of the rotary shaft. The sheet material cutting device further includes a sheet-suspension prevention unit configured to prevent a rear edge of the sheet material in its feed direction, which is cut by the rotatable blade and the fixed blade, from being suspended within the support frame.

Now, exemplary embodiments will be hereinafter described in detail with reference to the accompanying drawings.

Figure 1:
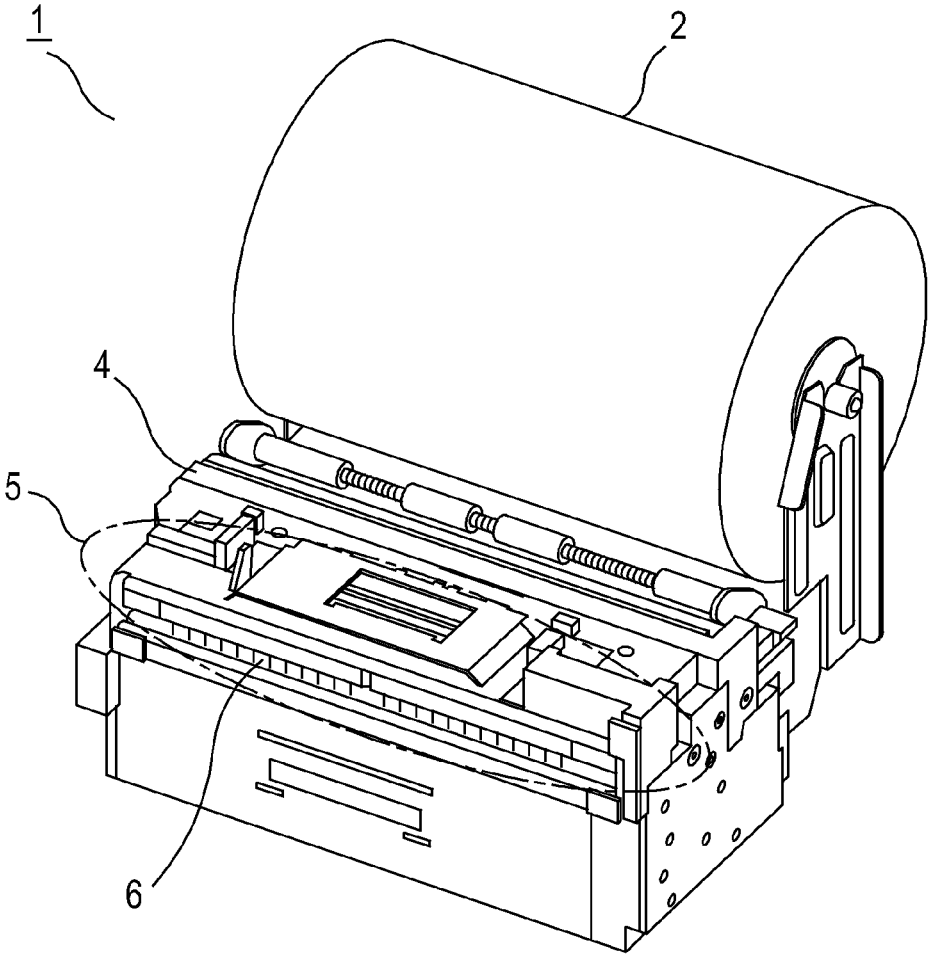
FIG. 1 is a perspective view of a printer according to an exemplary embodiment.
Figure 2:
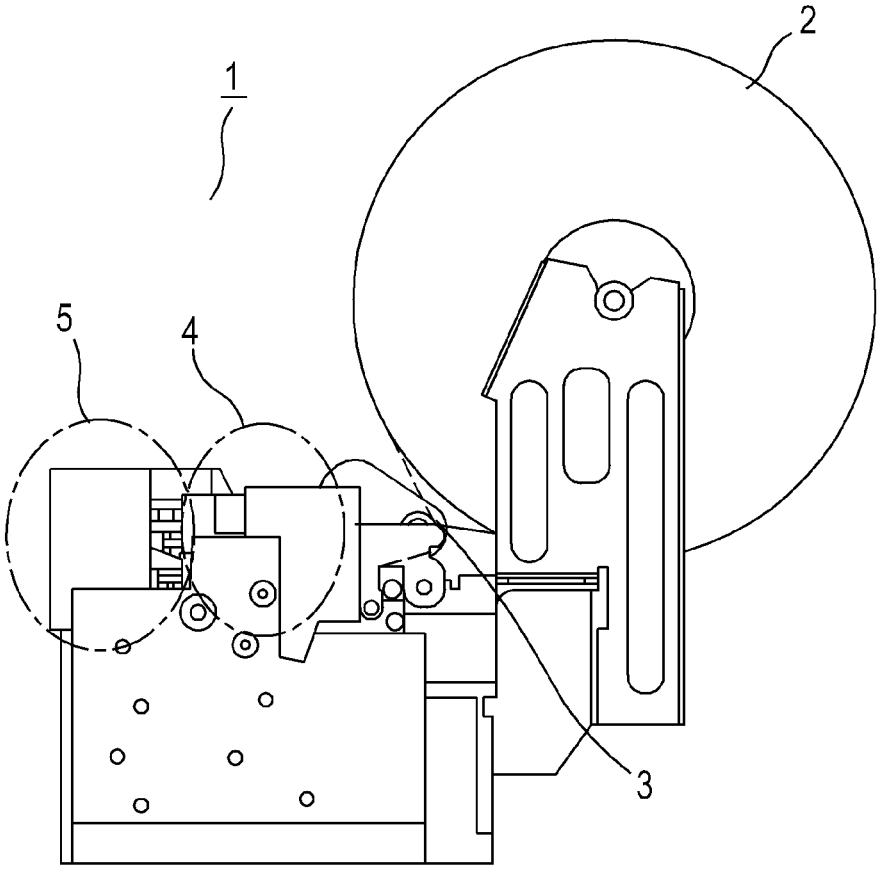
FIG. 2 is a side view of the printer.

FIGS. 1 and 2 show an example of a printer according to one embodiment. In FIGS. 1 and 2, a paper roll with an elongated sheet material 2 (hereinafter, described as "sheet to be printed") wound thereon is rotatably attached at a rear portion (i.e., right side of FIG. 2) of a printer main body 1. One end of the sheet 2 is inserted into the printer main body 1 from a sheet material supply unit 3 and is conveyed to a print unit (i.e., thermal head) 4 in the printer main body 1 by a conveying mechanism (not shown). The print unit 4 prints a certain character, a figure or the like on the conveyed sheet. The printed sheet 2 is conveyed in the longitudinal direction thereof, so that a leading edge of the printed sheet 2 passes through a sheet material cutting device 5 positioned in the proximity of the print unit 4. Then, the printed sheet 2 is discharged to the outside through a discharge unit 6 formed at an upper portion of a front side (i.e., left side of FIG. 2) of the printer main body 1.

The sheet material cutting device 5 cuts the elongated sheet material 2 in a transverse direction perpendicular to the feed direction of the sheet material 2 when a leading edge of the sheet 2 is conveyed by a predetermined distance. Since the leading edge of the sheet material 2 is already discharged out of the discharge unit 6 when it is cut to a desired length, the cut sheet hangs down due to its own weight.

Figure 3:
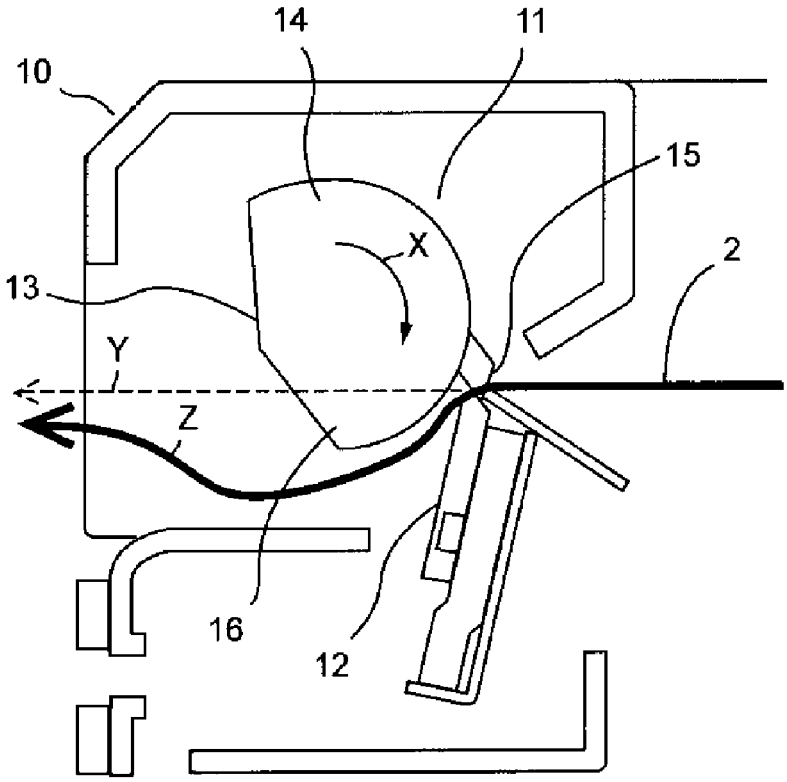
FIG. 3 is a cross-sectional view showing a schematic structure of a sheet material cutting device according to an exemplary embodiment.

The sheet material cutting device 5 is constructed as shown in FIG. 3. In FIG. 3, the sheet material cutting device 5 includes a rotatable blade 11 and a fixed blade 12. The rotatable blade 11 has a rotary shaft 14 rotatably mounted at both ends to a support frame 10. The rotary shaft 14 has a flat portion 13 formed on the outer circumference thereof in such a fashion that about half of the outer circumferential surface of the rotary shaft 14 defines an exterior angle which measures approximately 190° in arc. The flat portion 13 is formed to enable a leading edge of the printed sheet material 2 being fed from the right side of FIG. 3 to be inserted between the rotatable blade 11 and the fixed blade 12. That is, without the flat portion 13, the leading edge of the sheet material 2 may abut against the outer circumferential surface of the rotary shaft 14, so that the sheet material 2 is impeded from being inserted between the rotatable blade 11 and the fixed blade 12. Formation of the flat portion 13 allows the leading edge of the sheet material 2 to move along the outer surface of the flat portion 13 to cause the sheet material 2 to be inserted between the rotatable blade 11 and the fixed blade 12.

Figure 4:
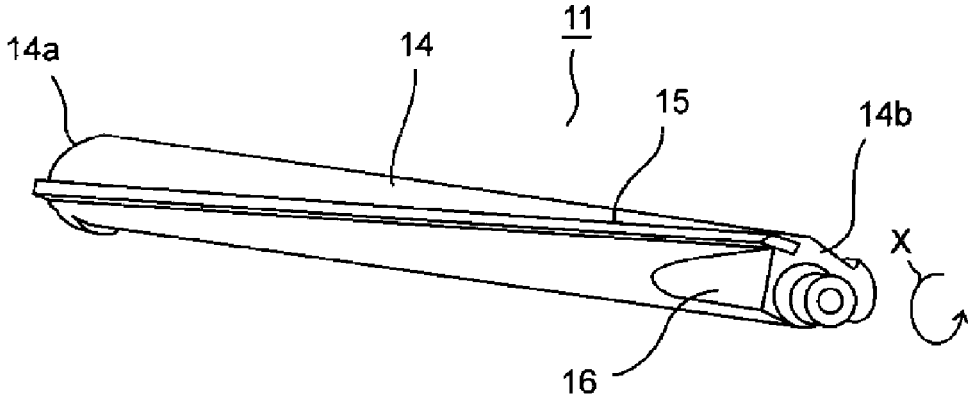
FIG. 4 is a perspective view of a rotatable blade used in the sheet material cutting device.

In addition, the rotatable blade 11 has a blade unit 15 extending from one end 14*a* of the rotary shaft 14 to the other end 14*b* thereof as shown in FIG. 4. The blade unit 15 defines a predetermined angle relative to an axial direction of the rotary shaft 14.

The fixed blade 12 is disposed within the support frame 10 so as to be opposed to the rotatable blade 11. The fixed blade 12 is configured to cut the sheet 2, which is being fed in a direction perpendicular to the axial direction of the rotary blade 11 by rotation of the rotatable blade 11 in the direction of an arrow X, in a transverse direction perpendicular to the feed direction of the sheet.

In one exemplary embodiment, a sheet-suspension prevention unit is provided which prevents a rear edge of the sheet 2 in its feed direction, which is cut by the rotatable blade 11 and the fixed blade 12, from being suspended within the support frame 10. The sheet-suspension prevention unit is formed at the rotary shaft 14 of the rotatable blade 11 so as to prevent the leading edge of the sheet 2, which is cut by cooperative operation between the rotatable blade 11 and the fixed blade 12, from being suspended within the support frame 10. In this exemplary embodiment, in the direction of forwarding the blade unit 15 in the rotational direction X of the rotary shaft 14, on the outer circumferential surface of the rotary shaft 14 constituting the rotatable blade 11 is formed a chamfered portion 16. The degree of being chamfered in the chamfered portion 16 is reduced gradually as it goes from a cutting termination portion (one end 14*b* of the rotary shaft 14) of the blade unit 15 toward a cutting start portion (the other end 14*a* of the rotary shaft 14) thereof. The chamfered portion 16 functions as the sheet-suspension prevention unit.

Under the above construction, one end of the sheet 2 wound in the shape of a roll is inserted into the printer main body 1 from the sheet material supply unit 3, and is printed on its surface with a given character or figure, or the like in the print unit 4 within the printer main body 1. The printed sheet 2 is fed to the sheet material cutting device 5. At this time, the rotatable blade 11 is in a state where the flat portion 13 formed on the rotary shaft 14 is directed downward. The leading edge of the sheet 2 is conveyed to the left side of FIG. 3 along the flat portion 13, and is discharged to the outside through the discharge unit 15 formed at the front upper portion of the printer main body 1 while being suspended downward.

When a sensor (not shown) determines that a leading edge of an elongated sheet 2 is conveyed by a predetermined distance, the material cutting device 5 cuts the sheet 2 in the transverse direction perpendicular to the feed direction of the sheet 2. The leading edge of the sheet 2 is already discharged out of the discharge unit 6 when it is cut to have a desired length, the cut sheet hangs down outside due to its own weight.

The above-described cutting operation is performed by rotating the rotatable blade 11 in the direction of an arrow X of FIG. 3. That is, the rotation of rotatable blade 11 in the direction of an arrow X allows the sheet 2 placed between the rotatable blade 11 and the fixed blade 12 to be engaged with the fixed blade 12 and cut starting from one end 14*a* of the rotary shaft 14 shown in FIG. 4. As the point of engagement between the blade unit 15 and the fixed blade 12 continuously progresses toward the other end 14*b* by rotation of the rotatable blade 11, the cut portion of the sheet 2 also transits in the same direction as the progress direction of the engagement. Then, as the point of the engagement between the blade unit 15 and the fixed blade 12 reaches the other end 14*b* of the rotary shaft 14, the cutting operation of the sheet 2 is terminated. This sheet cutting operation allows the sheet 2 to be cut in the transverse direction to perpendicular to the feed direction of the sheet.

FIG. 3 schematically shows the operational relationship between the rotatable blade 11 and the fixed blade 12 immediately before the cutting operation is terminated. In the conventional configuration, the rear end portion of the sheet 2 in its feed direction, which is cut by the rotatable blade 11 and the fixed blade 12, is pressed downward by the forward shaft surface having a circular arc shape in front of the blade unit 15 in the rotational direction of the rotary shaft 14 as indicated by a solid line Z of FIG. 3, so that the rear end portion of the sheet 2 is bent downward into deformation. For this reason, the bent rear end portion of the cut sheet is jammed inside. This obstructs the operation of discharging the cut sheet due to its own weight, which causes sheet blockage or jam in the proximity of the discharge unit.

On the other hand, in the present embodiment, in front of the blade unit 15 in the rotational direction X of the rotary shaft 14 on the outer circumferential surface of the rotary shaft 14 constituting the rotatable blade 11 is formed a chamfered portion 16 as a sheet-suspension prevention unit. The degree of being chamfered in the chamfered portion 16 is reduced gradually as it goes from a cutting termination portion (one end 14*b* of the rotary shaft 14) of the blade unit 15 toward a cutting start portion (the other end 14*a* of the rotary shaft 14) thereof as shown in FIG. 4. Thus, the rear end portion of the cut sheet 2 is prevented from being pressed downward as indicated by the solid line Z mentioned above. That is, the rear end portion of the cut sheet 2 is conveyed to the left side of FIG. 3 without being pressed, bent and deformed downward by the rotary shaft 14, as indicated by a doted line of FIG. 3. Thus, since the leading edge of the sheet material 2 is already discharged out of the discharge unit 6 as shown in FIG. 1 when the sheet is being cut at the rear edge thereof, the sheet is surely discharged outside of the device and hangs down in its entirety due to its own weight.

In FIG. 4, the chamfered portion 16 is formed in a relatively narrow range extending from one end 14*b* of the rotary shaft 14 toward the other end 14*a* thereof This prevents a significant deformation of the corners of the rear edge of the sheet at the cutting termination end side, i.e., the end 14*b* of the rotary shaft 14 in the conventional cutting operation, which causes the rear end portion of the sheet to be suspended inside. That is, the chamfered portion 16 is shown in its least size range to prevent deformation of the corners of the rear edge of the sheet. Thus, the chamfered portion 16 may be formed in such a fashion that the degree of being chamfered is reduced gradually over its entire length from one end 14*b* of the rotary shaft 14 toward the other end 14*a* thereof. Such formation of the chamfered portion 16 prevents the rear end portion of the sheet from being bent downward and deformed in its entirety. In this manner, the function of the chamfered portion as the sheet-suspension prevention unit can be further ensured.

Next, a sheet material cutting device 5 according to another exemplary embodiment will be described hereinafter with reference to FIGS. 5 to 7.

Figure 5:
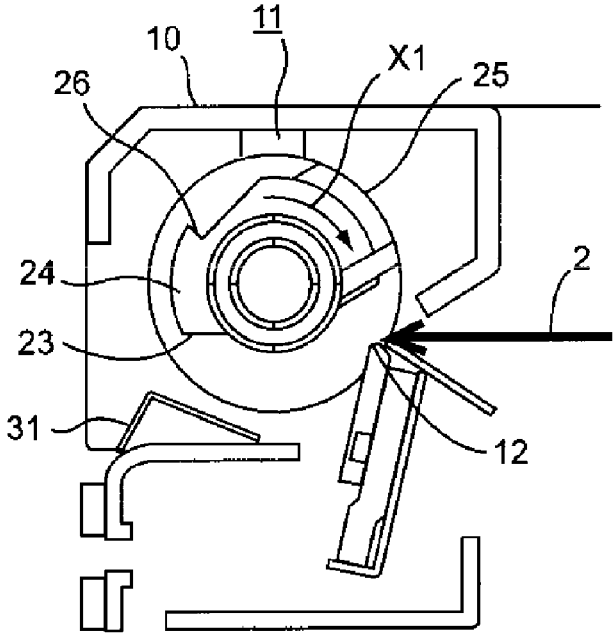
FIG. 5 is a cross-sectional view showing a schematic structure of a sheet material cutting device according to another exemplary embodiment.
Figure 6:
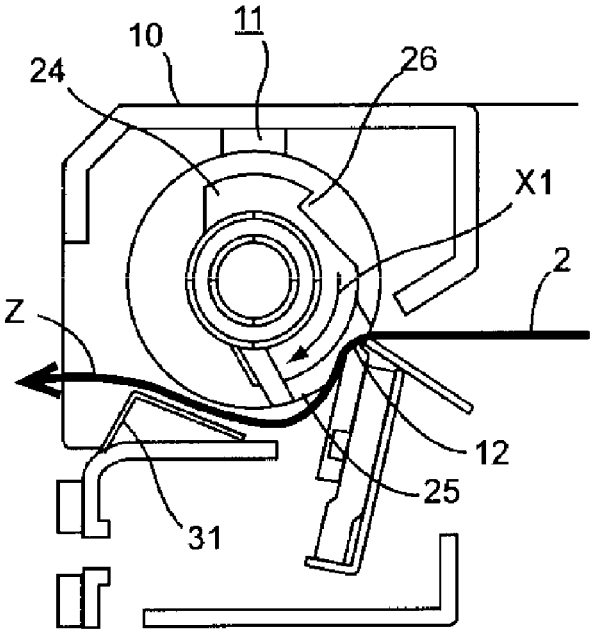
FIG. 6 is a cross-sectional view showing a state in which a cutting operation is performed by the sheet material cutting device.

As shown in FIGS. 5 and 6, the sheet material cutting device 5 includes a rotatable blade 11 and a fixed blade 12. The rotatable blade 11 is rotatably mounted at both ends to a support frame 10. That is, the basic configuration of the sheet material cutting device 5 shown in FIGS. 5 and 6 is the same as that of the sheet material cutting device shown in FIG. 3 except that the rotatable blade 11 shown in FIG. 7 has a different structure from that shown in FIG. 4.

Figure 7:
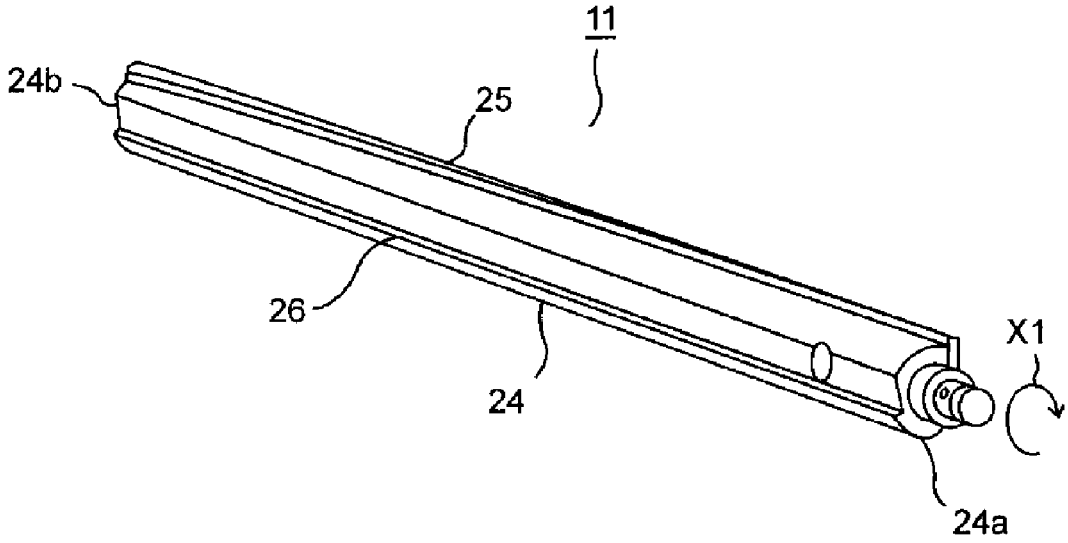
FIG. 7 is a perspective view of a rotatable blade used in the sheet material cutting device.

The rotatable blade 11 shown in FIG. 7 also includes a rotary shaft 24. As shown in FIGS. 5 and 6, the rotary shaft 24 has a flat portion 23 formed on the outer circumference thereof in such a fashion that about half of the outer circumferential surface of the rotary shaft 24 defines an exterior angle which measures approximately 190° in arc. The flat portion 23 is formed to allow a leading edge of the printed sheet material 2, which is being conveyed from the right side of FIG. 5, to be inserted between the rotatable blade 11 and the fixed blade 12.

In addition, the rotatable blade 11 has a blade unit 25 extending from one end 24*a* of the rotary shaft 24 to the other end 24*b* thereof as shown in FIG. 7. The blade unit 25 defines a predetermined angle relative to an axial direction of the rotary shaft 24.

The fixed blade 12 is disposed within the support frame 10 so as to be opposite the rotatable blade 11. The fixed blade 12 is configured to cut the sheet 2, which is being conveyed in a direction perpendicular to the axial direction of the rotary blade 11 by rotation of the rotatable blade 11 in the direction of an arrow X1, in a transverse direction perpendicular to the feed direction of the sheet 2.

In this exemplary embodiment, as a sheet-suspension prevention unit which prevents a rear edge of the sheet 2 in its feed direction, which is cut by the rotatable blade 11 and the fixed blade 12, from being suspended within the support frame 10, at the rear portion of the blade unit 25 in the rotational direction X1 on the outer circumferential surface of the rotary shaft 24 constituting the rotatable blade 11 is formed a stepped portion 26 along the axial direction of the rotary shaft 24. The stepped portion 26 is engaged with the rear edge of the cut sheet 2 by rotation of the rotatable blade 11 in the direction of an arrow X1.

Under the above construction, the printing and cutting operation is performed in the same manner as described in the above embodiment. That is, the sheet 2 wound in the shape of a roll is printed on its printing surface with a given character or figure, or the like in the print unit 4 and then is fed to the sheet material cutting device 5 adjacent to the print unit 4. In this case, the sheet material cutting device 5 is in a state in which the flat portion 23 formed on the rotary shaft 14 of the rotatable blade 11 is directed downward as shown in FIG. 5. The leading edge of the sheet 2 is inserted from the right side of FIG. 5 along the flat portion 23. Then, the leading edge of the sheet 2 is discharged to the outside through the sheet discharge unit 6 located at the front upper portion of the printer main body 1 and suspended downward.

When a sensor (not shown) determines that a leading edge of an elongated sheet 2 is conveyed by a predetermined distance, the material cutting device 5 cuts the sheet in the transverse direction perpendicular to the feed direction of the sheet. As such, the leading edge of the sheet 2 is already discharged out of the discharge unit 6 when it is cut to have a desired length, the cut sheet is discharged to the outside and hangs down due to its own weight.

The cutting operation is performed by rotating the rotatable blade 11 in the direction of an arrow X1 as shown in FIG. 6. That is, the rotation of rotatable blade 11 in the direction of an arrow X allows the sheet 2 placed between the rotatable blade 11 and the fixed blade 12 to be cut in the transverse direction perpendicular to the feed direction of the sheet by engagement between the blade unit 25 and the fixed blade 12.

FIG. 6 schematically shows the operational relationship between the rotatable blade 11 and the fixed blade 12 immediately before the cutting operation is terminated. The rear end portion of the sheet 2 in its feed direction, which is cut by the rotatable blade 11 and the fixed blade 12, is pressed downward by the forward shaft surface having a circular arc shape in front of the blade unit 25 in the rotational direction of the rotary shaft 24 as indicated by a solid line Z of FIG. 6, so that the rear end portion of the sheet 2 is bent downward into deformation. When the rotatable blade 11 is further rotated in the direction of an arrow X1 from the state shown in FIG. 6, the cut sheet is pressed downward as mentioned above and is repelled by its elasticity on a guide member 31 provided at the inner bottom portion of the support frame, which is inclined upward and toward a sheet discharge outlet (shown in the left side of FIG. 6), to cause the rear end portion of the sheet to be slightly lifted.

The rotatable blade 11 has the stepped portion 26 formed on the outer circumferential surface of the rotary shaft 24 at the rear of the blade unit 25 in the rotational direction X1 of the rotary shaft 24, so that the stepped portion 26 is engaged with the rear edge of the cut sheet by rotation of the rotatable blade 11. In this engagement state, as the rotatable blade 11 is further rotated, the stepped portion 26 pushes the engaged rear edge of the sheet in the left direction in FIG. 6. Thus, since the leading edge of the cut sheet is already discharged out of the discharge unit 6 shown in FIG. 1 when the rear edge thereof is pushed outwardly by the stepped portion 26, the cut sheet is surely discharged to the outside of the device and hangs down in its entirety due to its own weight. Therefore, the suspension of the cut sheet within the device can be surely prevented.

In some embodiments, the rotational speed of the rotatable blade 11 is not limited to a specific speed, but may be variable. That is, a rotation drive unit (not shown) may be controlled such that the rotational speed of the rotatable blade 11 when the rear edge of the sheet is engaged with the stepped portion 26 is higher than the rotational speed of the rotatable blade 11 relative to the sheet 2 at the time of the cutting start operation.

In this manner, when the control operation is performed, the rotational speed of the stepped portion 26 engaged with the rear edge of the cut sheet 2 is increased, so that the cut sheet 2 receives a strong extruding force by the stepped portion 26 so as to be much more surely discharged to the outside through the discharge unit 6.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet material cutting device comprising:

a rotatable blade including a blade unit provided on the outer circumference of a rotary shaft rotatably supported by a support frame, the blade unit extending from one end of the rotary shaft to the other end thereof and defining a predetermined angle relative to an axial direction of the rotary shaft;

a fixed blade mounted on the support frame so as to be opposed to the rotatable blade and configured to cut a sheet material in a transverse direction perpendicular to the feed direction of the sheet material, the sheet material being fed in a direction perpendicular to the axial direction of the rotary shaft by rotation of the rotatable blade; and a sheet-suspension prevention unit configured to prevent a rear edge of the sheet material in its feed direction, which is cut by the rotatable blade and the fixed blade, from being pressed downward by the outer circumference of the rotary shaft and suspended within the support frame; and wherein the sheet-suspension prevention unit comprises a chamfered portion located in front of the blade unit in the rotational direction of the rotary shaft on the outer circumferential surface of the rotary shaft, the chamfered portion being formed in such a fashion that the degree of being chamfered from the outer circumference toward an axis of the rotary shaft is reduced gradually as it goes from a cutting termination portion of the blade unit toward a cutting start portion thereof.

2. The device of claim 1, wherein the sheet-suspension prevention unit is located at the rotary shaft of the rotatable blade and configured to prevent the rear edge of the sheet material cut by cooperative operation of the rotatable blade and the fixed blade from being suspended within the support frame.

3. The device of claim 1, wherein a flat portion is formed on the outer circumference of the rotary shaft and is configured to enable a leading edge of the sheet material in its feed direction to be inserted between the rotatable blade and the fixed blade.

4. A printer comprising:

a sheet material supply unit configured to supply a sheet material to be printed;

a print unit configured to print a certain character or a figure on a sheet material supplied; and a sheet material cutting device configured to cut the sheet material printed by the print unit to have a desired length, wherein the sheet material cutting device comprises:

a rotatable blade including a blade unit provided on the outer circumference of a rotary shaft rotatably supported by a support frame, the blade unit extending from one end of the rotary shaft to the other end thereof and defining a predetermined angle relative to an axial direction of the rotary shaft;

a fixed blade mounted on the support frame so as to be opposed to the rotatable blade and configured to cut a sheet material in a transverse direction perpendicular to the feed direction of the sheet material, the sheet material being fed in a direction perpendicular to the axial direction of the rotary shaft by rotation of the rotatable blade; and a sheet-suspension prevention unit configured to prevent a rear edge of the sheet material in its feed direction, which is cut by the rotatable blade and the fixed blade, from being pressed downward by the outer circumference of the rotary shaft and suspended within the support frame; and wherein the sheet-suspension prevention unit of the sheet material cutting device comprises a chamfered portion formed in front of the blade unit in the rotational direction of the rotary shaft on the outer circumferential surface of the rotary shaft, the chamfered portion being formed in such a fashion that the degree of being chamfered from the outer circumference toward an axis of the rotary shaft is reduced gradually as it goes from a cutting termination portion of the blade unit toward a cutting start portion thereof.

5. The printer of claim 4, wherein the sheet-suspension prevention unit is located at the rotary shaft of the rotatable blade and configured to prevent the rear edge of the sheet material cut by cooperative operation of the rotatable blade and the fixed blade from being suspended within the support frame.

6. The printer of claim 4, wherein a flat portion is formed on the outer circumference of the rotary shaft and is configured to enable a leading edge of the sheet material in its feed direction to be inserted between the rotatable blade and the fixed blade.

7. A method for cutting sheet material, the method comprising:

receiving the sheet material between i) a rotatable blade including a blade unit provided on the outer circumference of a rotary shaft rotatably supported by a support frame, the blade unit extending from one end of the rotary shaft to the other end thereof and defining a predetermined angle relative to an axial direction of the rotary shaft; and ii) a fixed blade mounted on the support frame so as to be opposed to the rotatable blade such that the sheet material is fed in a direction perpendicular to the axial direction of the rotary shaft by rotation of the rotatable blade;

cutting the sheet material between the rotatable blade and the fixed blade in a transverse direction perpendicular to the feed direction of the sheet material;

preventing a rear edge of the sheet material from being pressed downward by the outer circumference of the rotary shaft and suspended within the support frame;

wherein a sheet-suspension prevention unit located at the rotary shaft of the rotatable blade prevents the rear edge of the sheet material cut by cooperative operation of the rotatable blade and the fixed blade from being suspended within the support frame; and wherein the sheet-suspension prevention unit comprises a chamfered portion located in front of the blade unit in the rotational direction of the rotary shaft on the outer circumferential surface of the rotary shaft, the chamfered portion being formed in such a fashion that the degree of being chamfered from the outer circumference toward an axis of the rotary shaft is reduced gradually as it goes from a cutting termination portion of the blade unit toward a cutting start portion thereof, and the chamfered portion preventing the rear edge of the sheet material cut by cooperative operation of the rotatable blade and the fixed blade from being suspended within the support frame.

8. The method of claim 7, further comprising inserting a leading edge of the sheet material in its feed direction between the rotatable blade and the fixed blade, wherein a flat portion is formed on the outer circumference of the rotary shaft and is configured to enable the leading edge of the sheet material to be inserted between the rotatable blade and the fixed blade.

* * * * *